US011761628B2

(12) United States Patent
Bowin

(10) Patent No.: US 11,761,628 B2
(45) Date of Patent: Sep. 19, 2023

(54) SYSTEM AND METHOD FOR BREAKING APART A SUBSTANCE

(71) Applicant: United Conveyor Corporation, Waukegan, IL (US)

(72) Inventor: Dennis Bowin, Windsor, CT (US)

(73) Assignee: United Conveyor Corporation, Waukegan, IL (US)

( * ) Notice: Subject to any disclaimer, the term of this patent is extended or adjusted under 35 U.S.C. 154(b) by 126 days.

(21) Appl. No.: 17/268,263

(22) PCT Filed: Apr. 29, 2020

(86) PCT No.: PCT/US2020/030388
§ 371 (c)(1),
(2) Date: Feb. 12, 2021

(87) PCT Pub. No.: WO2020/226959
PCT Pub. Date: Nov. 12, 2020

(65) Prior Publication Data

US 2022/0042681 A1 Feb. 10, 2022

Related U.S. Application Data

(60) Provisional application No. 62/842,609, filed on May 3, 2019.

(51) Int. Cl.
*F23J 1/06* (2006.01)

(52) U.S. Cl.
CPC ..... *F23J 1/06* (2013.01)

(58) Field of Classification Search
CPC ..... F23J 1/06; F23J 1/00
See application file for complete search history.

(56) References Cited

U.S. PATENT DOCUMENTS 661,445 A 11/1900 Duff
1,360,805 A * 11/1920 Sherman ..... F23J 1/00 110/165 R
4,020,773 A * 5/1977 Blach ..... F23J 1/00 110/165 R
4,073,244 A * 2/1978 Snowdon ..... B65G 53/12 110/165 R
2011/0000147 A1 1/2011 Heidenreich

FOREIGN PATENT DOCUMENTS

GB 191203858 A 1/1911

OTHER PUBLICATIONS

International Search Report dated Aug. 3, 2020 from corresponding PCT application No. PCT/US2020/030388.

* cited by examiner

*Primary Examiner* — David J Laux
(74) *Attorney, Agent, or Firm* — Vitale Vickrey Niro & Gasey; Arthur Gasey

(57) ABSTRACT

An apparatus for breaking apart a substance is provided. The apparatus includes a body configured to be selectively secured via a fastener between two surfaces of a container and to break apart the substance upon impact. At least a portion of the body is operative to drop towards a bottom surface of the container upon removal of the fastener so as to facilitate removal of the substance from the container.

12 Claims, 6 Drawing Sheets

SYSTEM AND METHOD FOR BREAKING APART A SUBSTANCE

CROSS REFERENCE TO RELATED APPLICATIONS

This application is a national stage of International Application No. PCT/US2020/030388 filed on Apr. 29, 2020, which claims priority to U.S. Provisional Application No. 62/842,609 filed on May 3, 2019, all of which are hereby incorporated by reference in their entireties.

BACKGROUND

Technical Field

Embodiments of the invention relate generally to a system and method for breaking apart a substance, and more specifically to a system and method for breaking apart slag deposits in a hopper or scrapper conveyor.

Discussion of Art

Many power plants burn fossil fuels, e.g., coal, within a combustion chamber, which in turn generates ash. The ash is often collected as it settles in large devices known as ash hoppers, also referred to herein simply as "hoppers". While most of the ash generated by a power plant directly deposits into the hoppers, some of the generated ash may form slag deposits in the upper portions of the combustion chamber, associated ducting, hoppers and/or other components of the power plant. After building up in size, slag deposits may fall down into a hopper.

Hoppers may include devices, referred to herein as "breaker bars", that span the interior of the hopper so as to break apart falling slag deposits on impact in order to prevent clogging of the hopper. While such bars may break apart most falling slag deposits, some deposits may remain unbroken, or otherwise intact, so as to become lodged above and against the bars, thereby clogging the hopper. Thus, many traditional hoppers require periodic cleaning, i.e., clearing/removal of the lodged slag deposits and/or ash, which is generally a manual process that involves physically entering the hopper and manually breaking up the lodged slag deposits and/or ash.

As traditional bars are permanently secured in place within a hopper, and as the lodged slag deposits and/or ash may be substantially massive, the lodged slag deposits and/or ash are typically cleared from above the breaker bars, as clearing from below is infeasible. Clearing slag deposits and ash from above the breaker bars, however, typically requires shutting down the boiler, entering the combustion chamber, and building complex scaffolding to reach the top of the clogged hopper.

What is needed, therefore, is an improved system and method for breaking apart a substance.

BRIEF DESCRIPTION

In an embodiment, an apparatus for breaking apart a substance is provided. The apparatus includes a body configured to be selectively secured via a fastener between two surfaces of a container and to break apart the substance upon impact. At least a portion of the body is operative to drop towards a bottom surface of the container upon removal of the fastener so as to facilitate removal of the substance from the container.

In another embodiment, a method for breaking apart a substance is provided. The method includes selectively fastening an apparatus via a fastener between two surfaces of a container. The method further includes receiving the substance at the container. The method further includes breaking apart the substance via impacting the substance on the apparatus. The method further includes selectively removing the fastener such that a portion of the apparatus drops towards a bottom surface of the container. The method further includes removing at least some of the substance from the container.

In yet another embodiment, a system for breaking apart a substance is provided. The system includes an apparatus and at least one fastener. The apparatus is configured to break apart the substance upon impact. The at least one fastener is operative to selectively secure the apparatus between two surfaces of a container. A portion of the apparatus is operative to drop towards a bottom surface of the container upon removal of the fastener so as to facilitate removal of the substance from the container.

DRAWINGS

The present invention will be better understood from reading the following description of non-limiting embodiments, with reference to the attached drawings, wherein below:

DETAILED DESCRIPTION

Figure 1:
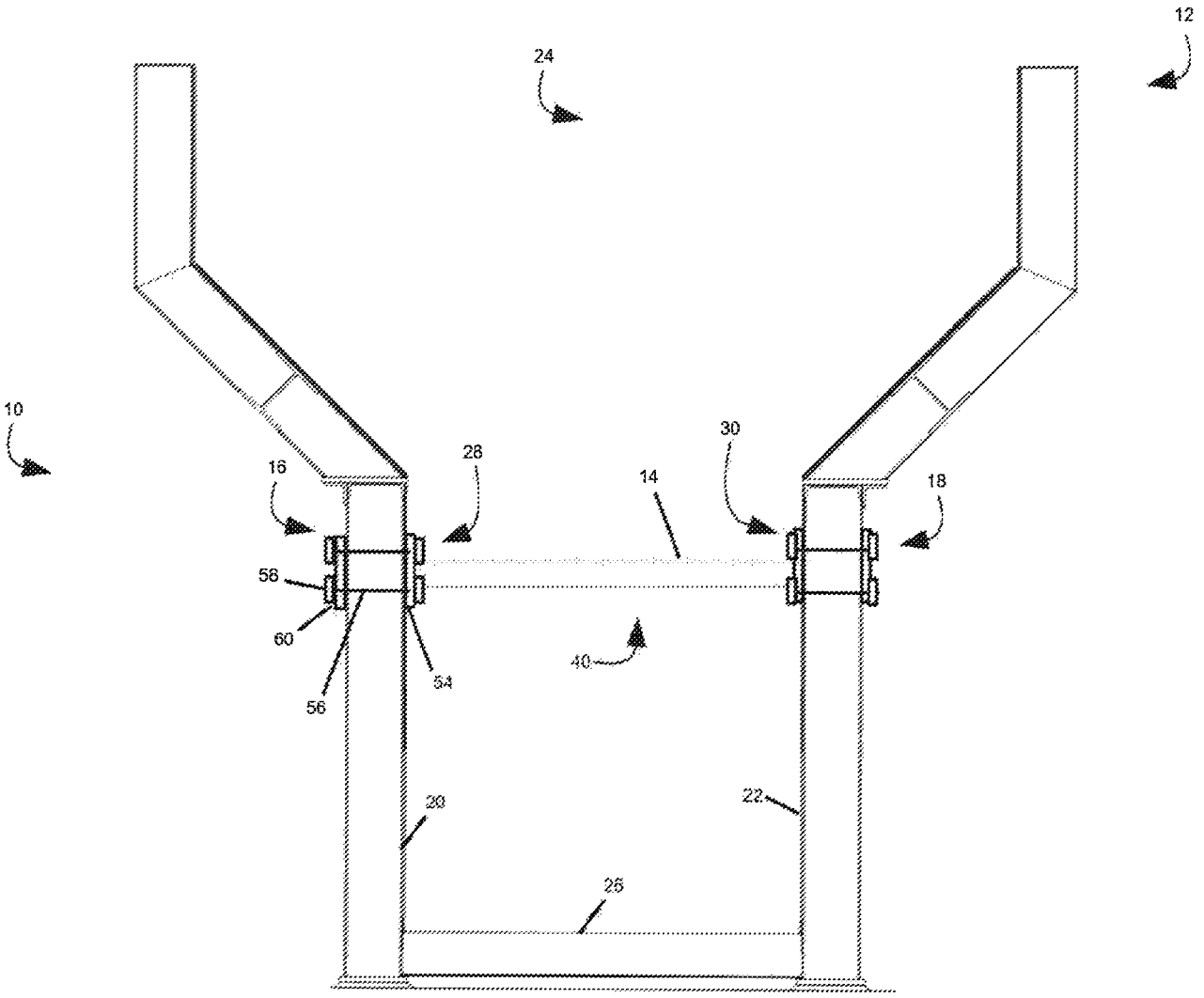
FIG. 1 is a schematic diagram of a system for breaking apart a substance, in accordance with an embodiment of the present invention.

Reference will be made below in detail to exemplary embodiments of the invention, examples of which are illustrated in the accompanying drawings. Wherever possible, the same reference characters used throughout the drawings refer to the same or like parts, without duplicative description.

As used herein, the terms "substantially," "generally," and "about" indicate conditions within reasonably achievable manufacturing and assembly tolerances, relative to ideal desired conditions suitable for achieving the functional purpose of a component or assembly. As also used herein, the term "fluidly connected" means that the referenced elements are connected such that a fluid (to include a liquid, gas, and/or plasma) may flow from one to the other. Accordingly, the terms "upstream" and "downstream," as used herein, describe the position of the referenced elements with respect to a flow path of a fluid and/or gas flowing between and/or near the referenced elements. Further, the term "stream," as used herein with respect to particles, means a continuous or near continuous flow of particles. As also used herein, the term "heating contact" means that the referenced objects are in proximity of one another such that heat/thermal energy can transfer between them.

Additionally, while the embodiments disclosed herein are primarily described with respect to an ash hopper for a coal-based power plant, it is to be understood that embodiments of the invention may be applicable to any apparatus and/or methods that need to break apart/declump a substance within a hopper or other container.

Referring now to FIG. 1, a system 10 for breaking apart a substance, e.g., slag deposits, ash and/or other substance which has a tendency to clump, is shown disposed within a "container" such as a hopper 12, e.g., an ash hopper or ash scrapper conveyor, in accordance with an embodiment of the present invention. The system 10 includes an apparatus 14, e.g., a breaker bar, and at least one fastener 16 and/or 18. The fastener 16 and/or 18 selectively secures the apparatus 14 between two surfaces 20 and 22 of the container/hopper 12, so that at least some slag deposits and/or ash falling into a top opening 24 of the hopper 12 break apart upon impacting the apparatus 14 and collect on a bottom surface 26 of the hopper 12. As used herein, "selectively secure," and "selectively" generally, refers to elements that can be separated, and subsequently reattached, without cutting, blasting, shredding or otherwise altering the structure of the referenced elements.

Figure 2:
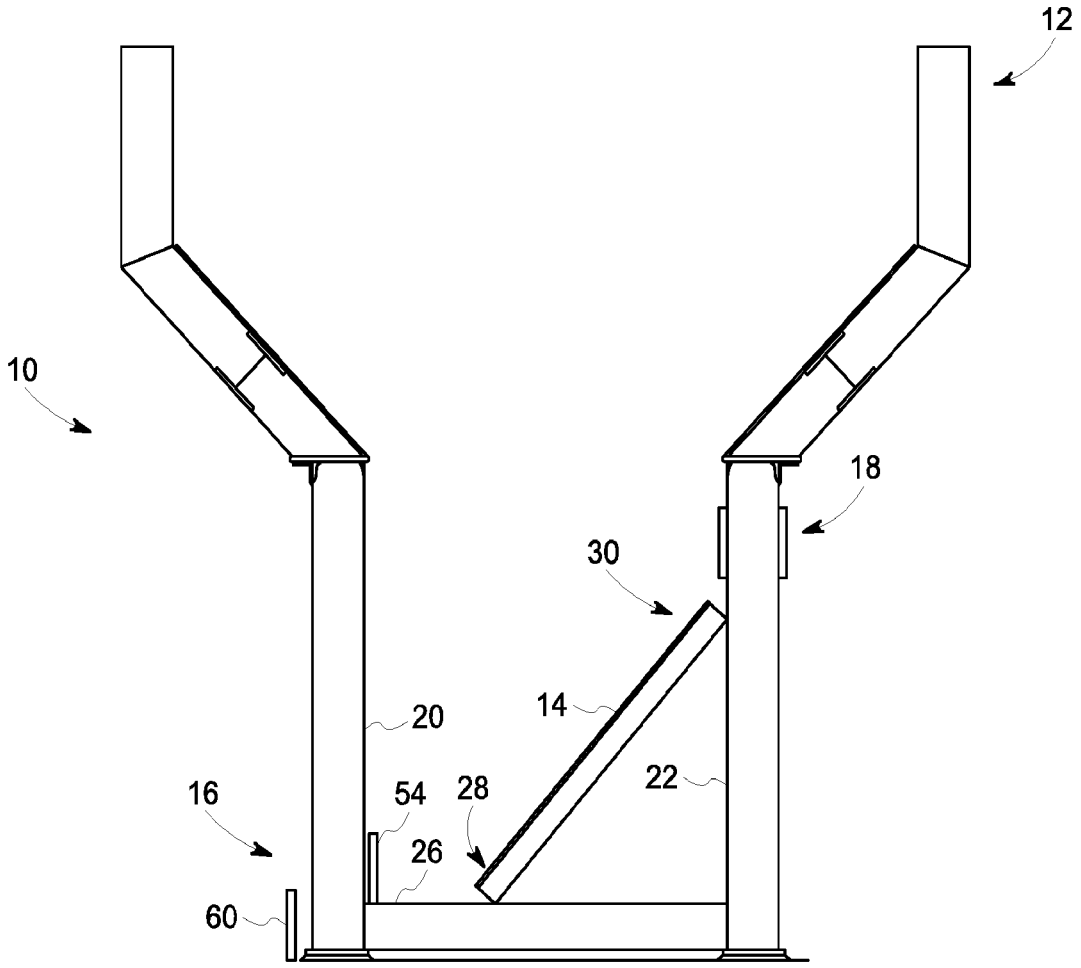
FIG. 2 is another schematic diagram of the system of FIG. 1, in accordance with an embodiment of the present invention.

As shown in FIG. 2, and as will be explained in greater detail below, a portion 28 and/or 30, e.g., a terminal end portion, of the apparatus 14 is operative to drop or otherwise move towards the bottom surface 26 upon removal of a fastener 16 and/or 18. With the apparatus 14 no longer fixed in place between the surfaces 20 and 22, any accumulated slag deposits and/or ash previously lodged against the apparatus 14 will also drop to the bottom surface 26 where it can be removed.

Figure 3:
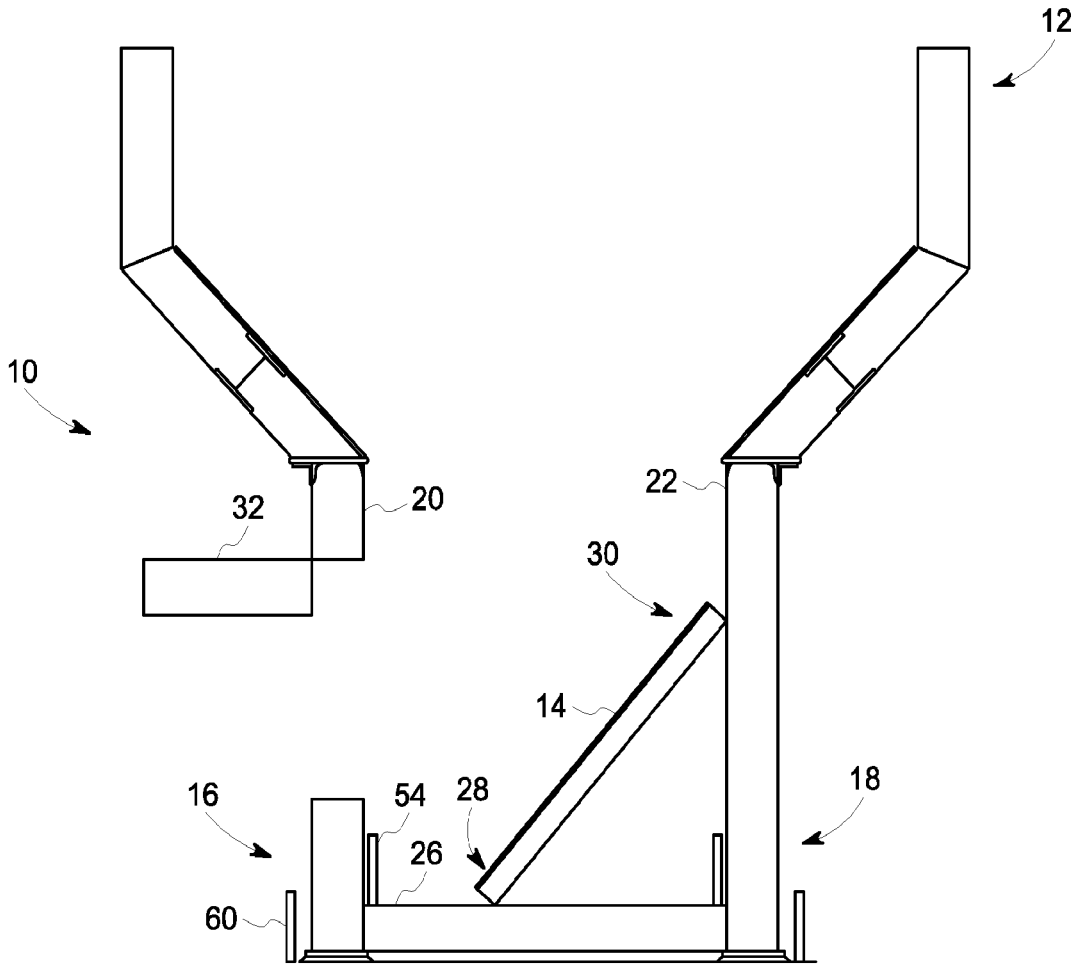
FIG. 3 is yet another schematic diagram of the system of FIG. 1, in accordance with an embodiment of the present invention.

Turning to FIG. 3, after an end 28, 30 of the apparatus 14 has dropped towards the bottom surface 26, a door 32, or other access panel, in the hopper 12 may be opened to facilitate removal of the accumulated slag deposits and/or ash. The apparatus 14 may then be selectively re-fastened via the fastener 16 and/or 18 back in place between the two surfaces 20 and 22 and the door 32 closed.

Figure 4:
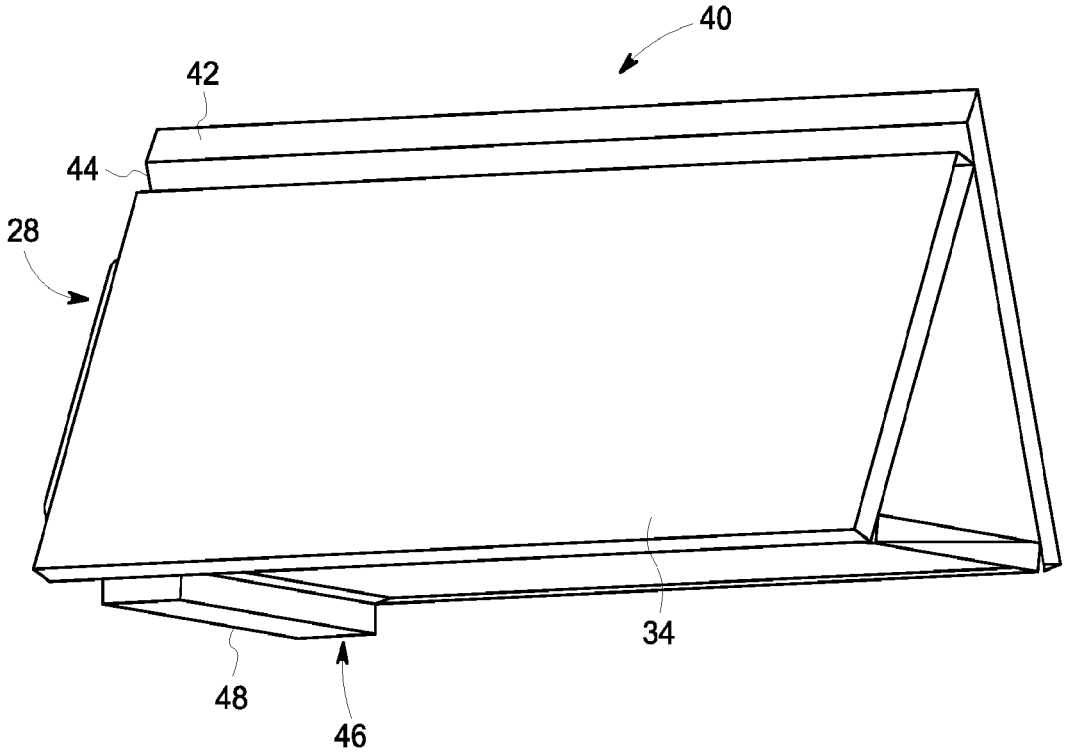
FIG. 4 is a schematic diagram of an apparatus of the system of FIG. 1, in accordance with an embodiment of the present invention.

Turning to FIG. 4, a first end 28 (also shown in FIGS. 1-3) of a body 34, e.g., a breaker bar, of the apparatus 14 is shown. As will be understood, the body 34 may have a second end 30 (shown in FIGS. 1-3) disposed opposite the first end 34 with respect to a middle portion 40. In embodiments, the second end 30 may mirror the first end 28. As will be appreciated, the body 34 is configured to break apart the substance upon impact. For example, in embodiments, the body 34 may have a substantially triangular shape, as shown in FIG. 4. It will be understood, however, that the body 34 may take other shapes, e.g., square, t-shaped, etc., capable of suitably breaking apart the substance upon impact. The body 34 may further have a leading edge 42 configured to impact the substance prior to other portions of the body 34. As will be appreciated, the leading edge 42 may be sharp so as to promote breaking of the substance. The body 34 may further have a lip 44, i.e., a portion of the body 34 extending over another portion of the body 34, which, in embodiments, may form the leading edge 42. The body 34 may further have one or more openings 46 disposed at and/or near the first 28 and/or second 30 ends. The apparatus 14 may further include at least one fastener 48, e.g., a "keeper bar", disposed over one or more of the openings 46. In embodiments, the fastener 48 may be welded to the body 34. In embodiments, the body 34 may be made from carbon, high strength-low alloy, heat and/or corrosion resistant steel, and/or other suitable materials.

Figure 5:
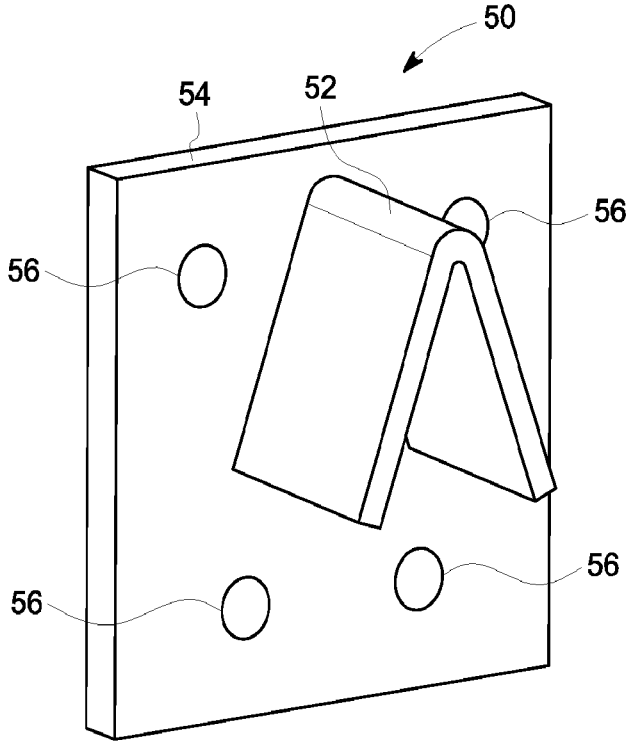
FIG. 5 is a schematic diagram of a fastener of the system of FIG. 1, in accordance with an embodiment of the present invention.
Figure 6:
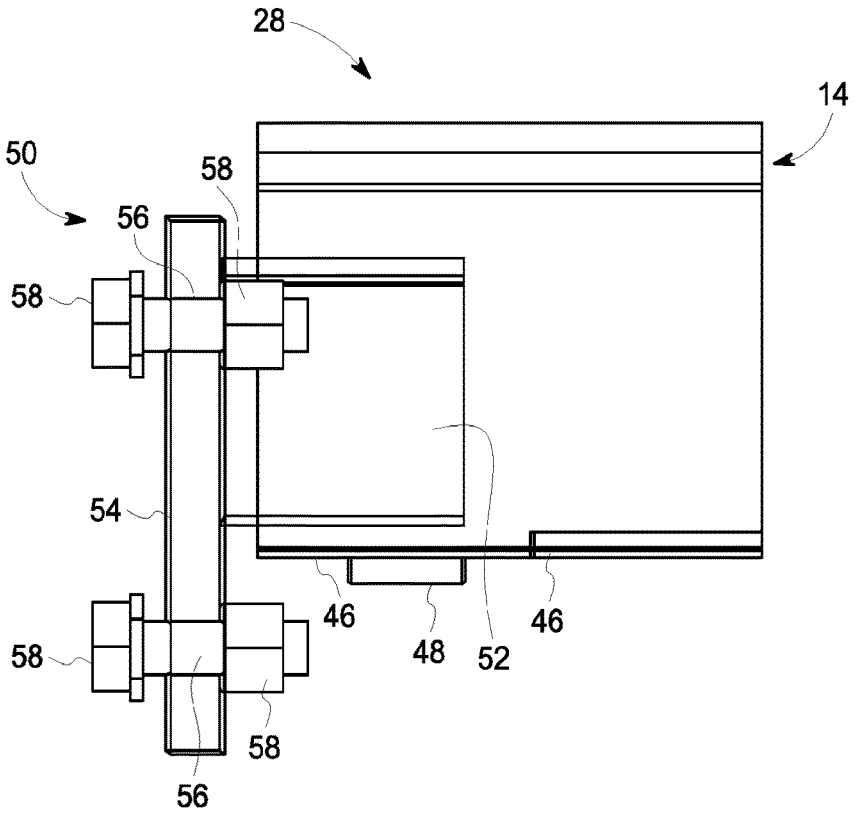
FIG. 6 is a schematic diagram of the apparatus of FIG. 4 selectively fastened to the fastener of FIG. 5, in accordance with an embodiment of the present invention.
Figure 7:
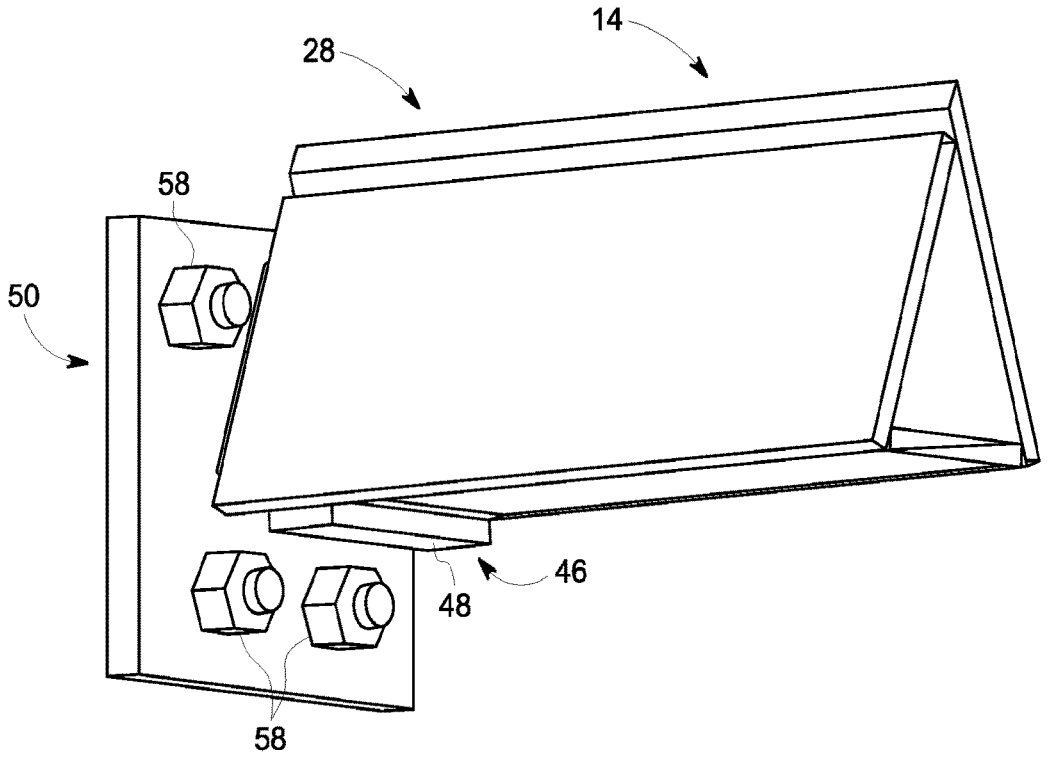
FIG. 7 is another schematic diagram of the apparatus of FIG. 4 selectively fastened to the fastener of FIG. 5, in accordance with an embodiment of the present invention.

Illustrated in FIG. 5 is an embodiment 50 representative of the fastener 16 and/or 18 shown in shown FIGS. 1-3. In embodiments, the fastener 50 may have a seat 52 configured to be received by the respective opening 46 as best seen in FIGS. 6 and 7. The seat 52 may have a shape conforming to the shape of the body 34 of the apparatus 14, e.g., a triangular shaped body 34 may warrant a triangular shaped seat 52. In embodiments, the fastener 50 may have a first portion 54 operative to be disposed within the hopper or hopper 12 and a second portion 56 (FIGS. 1 and 5-6), 58 (FIGS. 1 and 6-7), and 60 (FIGS. 1-3) operative to extend outside of the hopper 12 and to facilitate removal of the fastener 48 from the exterior of the hopper 12. For example, in embodiments, the fastener 48 may be a bracket with a first plate 54 forming the first portion, and with one or more screws and/or bolts 56, nuts 58 and/or a second plate 60 forming the second portion, wherein the screws 56 extend though one of the surfaces 20 or 22 of the hopper 12 and the nuts 58 secure the second plate 60 to the screws 56 (shown in FIG. 1). In embodiments, the screws and/or bolts 56 may be made of commercial grade high strength steel.

Referring now to FIGS. 1 and 6, in operation in accordance with an embodiment, the apparatus 14 is selectively fastened in place via fasteners 16 and 18 within the interior of a hopper 12. As will be appreciated, the apparatus 14 may be selectively fastened in place by a maintainer entering the bottom of the hopper 12 via door 32 (FIG. 3). Once inside the hopper 12, the maintainer may engage the first 28 and/or second 30 end of the apparatus 14 with the respective fastener 16 and/or 18. In embodiments, engagement of an end, e.g., 28 with a fastener, e.g., 16 may include receiving the seat 52 (FIGS. 5 and 6) in the respective opening 46 and manipulating the apparatus 14 such that the fastener 48 interlocks with the seat 52 as best seen in FIG. 6. As will be appreciated, interlocking of the fastener 48 and seat 52 restricts the apparatus 14 from moving with respect to the seat 52 while the apparatus 14 is fastened/fixed in place between the surfaces 20 and 22. In embodiments, the seat 52 and/or fastener 48 may be configured to have a clearance space between each other so as to facilitate rotation of the seat 52 and/or apparatus 14 during selective removal of the fastener 16 and/or 18 as discussed below. After selectively fastening/fixing the apparatus 14 in the hopper 12, the maintainer may then exit the hopper and close the door 32 (FIG. 3).

Referring now to FIGS. 2 and 6, at the next scheduled (or unscheduled) cleaning of the hopper 12, the maintainer may selectively remove the fastener 16 and/or 18 by unscrewing the nuts 58 from the outside of the hopper 12. As shown in FIG. 2, unscrewing of the nuts 58 causes the seat 52 to become loose with respect to the fastener 48 of the apparatus 14 such that the seat 52 and/or the apparatus 14 rotates and/or falls/drops/moves towards the bottom surface 26 of the hopper 12, i.e., the apparatus 14 becomes unfastened/unfixed from its position between the surface 20 and 22. In embodiments, the dropping of one end, e.g., 28, may facilitate subsequent rotation and/or dropping/movement of the other end, e.g., 30 towards the bottom surface 26.

As shown in FIG. 3, with the apparatus 14 unfastened/unfixed from its place between the surfaces 20 and 22, any slag deposits and/or ash lodged against the apparatus 14 during the period it was fixed between the surfaces 20 and 22 transition/move/fall to the bottom surface 26, whereupon they can be removed from the lower part of the hopper 12 via door 32. After cleaning of the hopper 12 is complete, the maintainer may selectively re-fasten/re-fix the apparatus 14 back in place between the surfaces 20 and 22 via the fastener 16 and/or 18 as described above.

Further, while the embodiments herein depict the apparatus 14 falling to the bottom surface 26 of the container 14, it will be understood that, in other embodiments, the apparatus 14 need not reach the bottom surface 26 and/or may swing/pivot about one of the ends 28 and/or 30.

Figure 8:
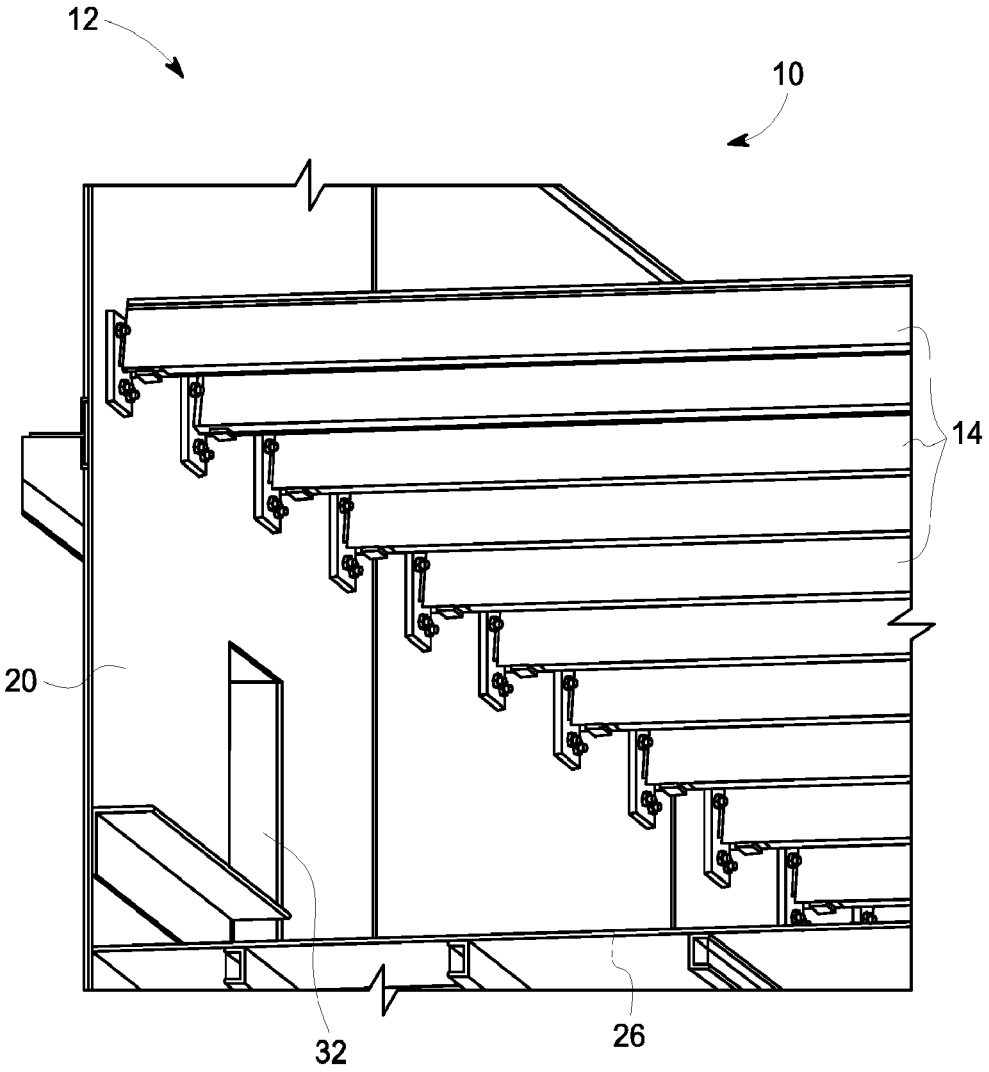
FIG. 8 is a schematic diagram of an embodiment of the system of FIG. 1 having a plurality of the apparatus of FIG. 4, in accordance with an embodiment of the present invention.

Further still, while FIGS. 1-3 depict a system 10 having a single apparatus 14, other embodiments may include two or more apparatuses 14 as shown in FIG. 8.

While the embodiments herein describe a manual process of unsecuring the apparatus 14, it will be understood that, in embodiments, the securing and/or unsecuring of the apparatus 14 may be mechanized via motors and/or other actuators. Such mechanized processes may be automated and/or otherwise facilitated by a controller/processor in electronic communication with the motors and/or actuators.

Finally, it is to be understood that the system 10 may include the necessary electronics, software, memory, storage, databases, firmware, logic/state machines, microprocessors, communication links, displays or other visual or audio user interfaces, printing devices, and any other input/output interfaces to perform the functions described herein, e.g., mechanization or automation, and/or to achieve the results described herein, which may be executed in real-time. For example, as stated above, the system 10 may include at least one processor and system memory/data storage structures in the form of a controller that electrically communicates with one or more of the components of the system 10. Additionally, a software application that provides for control over one or more of the various components of the system 10 may be read into a main memory of the at least one processor from a computer-readable media.

It is further to be understood that the above description is intended to be illustrative, and not restrictive. For example, the above-described embodiments (and/or aspects thereof) may be used in combination with each other. Additionally, many modifications may be made to adapt a particular situation or material to the teachings of the invention without departing from its scope.

For example, in an embodiment, an apparatus for breaking apart a substance is provided. The apparatus includes a body configured to be selectively secured via a fastener between two surfaces of a container and to break apart the substance upon impact. At least a portion of the body is operative to drop towards a bottom surface of the container upon removal of the fastener so as to facilitate removal of the substance from the container. In certain embodiments, the body has a substantially triangular shape. In certain embodiments, the body has a lip. In certain embodiments, the body has a leading edge configured to impact the substance prior to other portions of the body. In certain embodiments, the fastener includes a bracket having a seat, and the body includes an opening operative to receive the seat. In certain embodiments, the apparatus further includes a fastener operative to engage the seat and restrict the body from moving with respect to the seat while the body is selectively secured between the two surfaces. In certain embodiments, the fastener has a first portion operative to be disposed within the container and a second portion operative to extend outside of the container and facilitate removal of the fastener. In certain embodiments, the apparatus is at least one of an ash hopper or an ash scrapper conveyor, and the substance includes slag deposits.

Yet another embodiment provides for a method for breaking apart a substance. The method includes selectively fastening an apparatus via a fastener between two surfaces of a container. The method further includes receiving the substance at the container. The method further includes breaking apart the substance via impacting the substance on the apparatus. The method further includes selectively removing the fastener such that a portion of the apparatus drops towards a bottom surface of the container. The method further includes removing at least some of the substance from the container.

Still yet another embodiment provides for a system for breaking apart a substance. The system includes an apparatus and at least one fastener. The apparatus is configured to break apart the substance upon impact. The at least one fastener is operative to selectively secure the apparatus between two surfaces of a container. A portion of the apparatus is operative to drop towards a bottom surface of the container upon removal of the fastener so as to facilitate removal of the substance from the container.

Accordingly, by providing for an apparatus, e.g., a breaker bar, that is both configured to break apart a substance within a container upon impact, and selectively securable to the interior of the container, some embodiments of the present invention may provide for the cleaning of an ash hopper and/or ash scrapper of a power plant, or other device having a combustion chamber, without requiring stoppage/pausing of the operation of the power plant and/or requiring maintainers to traverse the innards of the combustion chamber and/or associated ducting/scaffolding.

Further, by providing for an apparatus having a triangular body with a lip and/or leading edge, some embodiments of the present invention provide for a breaker bar having improved strength and/or functionality over traditional designs. For example, in some embodiments, the triangular shape of the body resists and/or prevents torsion and/or lateral bucking distortion of the breaker bar.

While the dimensions and types of materials described herein are intended to define the parameters of the invention, they are by no means limiting and are exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, terms such as "first," "second," "third," "upper," "lower," "bottom," "top," etc. are used merely as labels, and are not intended to impose numerical or positional requirements on their objects. Further, the limitations of the following claims are not written in means-plus-function format and are not intended to be interpreted as such, unless and until such claim limitations expressly use the phrase "means for" followed by a statement of function void of further structure.

This written description uses examples to disclose several embodiments of the invention, including the best mode, and also to enable one of ordinary skill in the art to practice the embodiments of invention, including making and using any devices or systems and performing any incorporated methods. The patentable scope of the invention is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

Since certain changes may be made in the above-described invention, without departing from the spirit and scope of the invention herein involved, it is intended that all of the subject matter of the above description shown in the accompanying drawings shall be interpreted merely as examples illustrating the inventive concept herein and shall not be construed as limiting the invention.

The invention claimed is:

1. An apparatus for breaking apart a substance, the apparatus comprising:

a body configured to be selectively secured via a fastener between two surfaces of a container and to break apart the substance upon impact; wherein at least a portion of the body is operative to drop towards a bottom surface of the container upon removal of the fastener so as to facilitate removal of the substance from the container;

wherein the apparatus is at least one of an ash hopper or an ash scraper conveyor, and the substance comprises slag deposits;

wherein the fastener has a first portion operative to be disposed within the container and a second portion operative to extend outside of the container and facilitate removal of the fastener.

2. The apparatus of claim 1, wherein the body has a substantially triangular shape.

3. The apparatus of claim 1, wherein the body has a lip.

4. The apparatus of claim 1, wherein the body has a leading edge configured to impact the substance prior to other portions of the body.

5. The apparatus of claim 1, wherein the fastener comprises a bracket having a seat, and the body comprises an opening operative to receive the seat.

6. The apparatus of claim 5, wherein the fastener is operative to engage the seat and restrict the body from moving with respect to the seat while the body is selectively secured between the two surfaces.

7. The apparatus of claim 1, wherein the apparatus swings or pivots about at least one of the ends.

8. The apparatus of claim 1, further including at least one access panel disposed in at least one of the two surfaces of the container.

9. The apparatus of claim 1, further including an actuator configured to mechanize the selectively securing of the body via the fastener.

10. The apparatus of claim 9, further including a controller operably connected to the actuator, the controller operative to execute a process for automating the selectively securing of the body via the fastener.

11. A method for breaking apart a substance, the method comprising: selectively fastening an apparatus via a fastener between two surfaces of a container, including interlocking the fastener and a seat to restrict a body of the apparatus from moving with respect to a seat thereof; receiving the substance at the container; breaking apart the substance via impacting the substance on the apparatus; selectively removing the fastener such that a portion of the apparatus drops towards a bottom surface of the container; and removing at least some of the substance from the container.

12. A system for breaking apart a substance, the system comprising:

an apparatus configured to break apart the substance upon impact; and at least one fastener operative to selectively secure the apparatus between two surfaces of a container;

wherein the fastener has a first portion operative to be disposed within the container and a second portion operative to extend outside of the container and facilitate removal of the fastener;

wherein a portion of the apparatus is operative to drop towards a bottom surface of the container upon removal of the fastener so as to facilitate removal of the substance from the container;

wherein the apparatus is at least one of an ash hopper or an ash scraper conveyor, and the substance comprises slag deposits.

* * * * *